US007144172B2

(12) United States Patent
Zhadanov et al.

(10) Patent No.: US 7,144,172 B2
(45) Date of Patent: Dec. 5, 2006

(54) CLEANING DEVICE WITH SPONGE-LIKE WORKING ELEMENT

(76) Inventors: Sam Zhadanov, 2944 W. 5th St. Apt 20J, Brooklyn, NY (US) 11224; Eli Zhadanov, 2944 W. 5th St. Apt 20J, Brooklyn, NY (US) 11224

( * ) Notice: Subject to any disclaimer, the term of this patent is extended or adjusted under 35 U.S.C. 154(b) by 0 days.

(21) Appl. No.: 11/330,745

(22) Filed: Jan. 13, 2006

(65) Prior Publication Data

US 2006/0127161 A1 Jun. 15, 2006

Related U.S. Application Data

(63) Continuation-in-part of application No. 10/836,718, filed on May 3, 2004, now abandoned.

(51) Int. Cl.
*A46B 11/00* (2006.01)
*A45D 33/00* (2006.01)
*A47K 7/02* (2006.01)

(52) U.S. Cl. ..... 401/127; 401/130; 401/121; 15/244.1

(58) Field of Classification Search ..... 401/126, 401/127, 130, 121; 15/244.1–244.4, 116.2, 15/119.2

See application file for complete search history.

(56) References Cited

U.S. PATENT DOCUMENTS 1,365,103 A * 1/1921 Hoffmann ..... 132/289
2,774,093 A * 12/1956 King ..... 401/122
2,983,944 A * 5/1961 Uselis ..... 15/244.1
6,976,282 B1 * 12/2005 Sie ..... 15/119.2

* cited by examiner

*Primary Examiner*—David J. Walczak
(74) *Attorney, Agent, or Firm*—I. Zborovsky

(57) ABSTRACT

A cleaning device, comprising a housing having a substantially vertical axis; a sponge-like working element movable between a working position in which it is located outside the housing for cleaning a surface, and a position in it is forcedly moved into the housing so as to be squeezed and therefore to expel liquid; and a removable plate which in an installed position extends substantially radially above the sponge-like working element so that a user can apply an action to the plate from above and therefore to apply an action on the sponge-like working element from above toward a surface to be cleaned substantially over a whole radial extension of the sponge-like element, while when the plate is removed the sponge-like working element is exposed from above and can be used with its lower, peripheral, and upper sides and with its lateral edge to extend into areas to be cleaned which are difficult to access.

4 Claims, 6 Drawing Sheets

CLEANING DEVICE WITH SPONGE-LIKE WORKING ELEMENT

CROSS-REFERENCE TO A RELATED APPLICATION

This application is a continuation-in-part of patent application Ser. No. 10/836,718 filed May 3, 2004 now abandoned.

BACKGROUND OF THE INVENTION

The present invention relates to cleaning devices. In particular it relates to cleaning devices which have a sponge-like working element to be used for cleaning of objects and the like by rubbing against the objects with application of water and/or washing solutions. Some of such devices are disclosed in U.S. Pat. Nos. 5,992,140; 5,522,110; 6,217,244; 1,065,975; 1,222,979; 5,060,338; 6,619,604; 4,955,747; 2,774,093; as well as in the above identified patent application Ser. No. 10/836,718. It is believed that the existing cleaning devices of this type can be further improved.

SUMMARY OF THE INVENTION

Accordingly, it is an object of the present invention to provide a cleaning device of the above mentioned general type, which is a further improvement of the existing devices.

In keeping with these objects and with others which will become apparent hereinafter, one feature of the present invention resides, briefly stated, in a cleaning device, comprising a housing having a substantially vertical axis; a sponge-like working element movable between a working position in which said sponge-like working element is located outside said housing for cleaning a surface, and a position in which said sponge-like working element is forcedly moved into said housing so as to be squeezed and therefore to expel liquid from said sponge-like working element; and a removable plate which in an installed position extends substantially radially above said sponge-like working element so that a user can apply an action to said plate from above and therefore to apply an action on said sponge-like working element from above toward a surface to be cleaned substantially over a whole radial extension of said sponge-like element, while when said plate is removed said sponge-like working element is exposed from above and can be used with its lower, peripheral, and upper sides and with its lateral edge to extend into areas to be cleaned which are difficult to access.

When the device is designed in accordance with the present invention, it can be used for multiple applications. In particular, when the plate is installed in the device, it is easy to clean open flat surfaces by applying a pressure to the plate and therefore and to the sponge-like working element from above. When however it is necessary to clean spaces which are difficult to access, for example to clean dishes, plates, glasses, cups, sinks, faucets, etc., the plate is removed and not only the lower side and the peripheral side, but also the upper side of the sponge-like working element is exposed, so that the working element can engage with its lateral edge into the corresponding objects which are difficult to clean.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
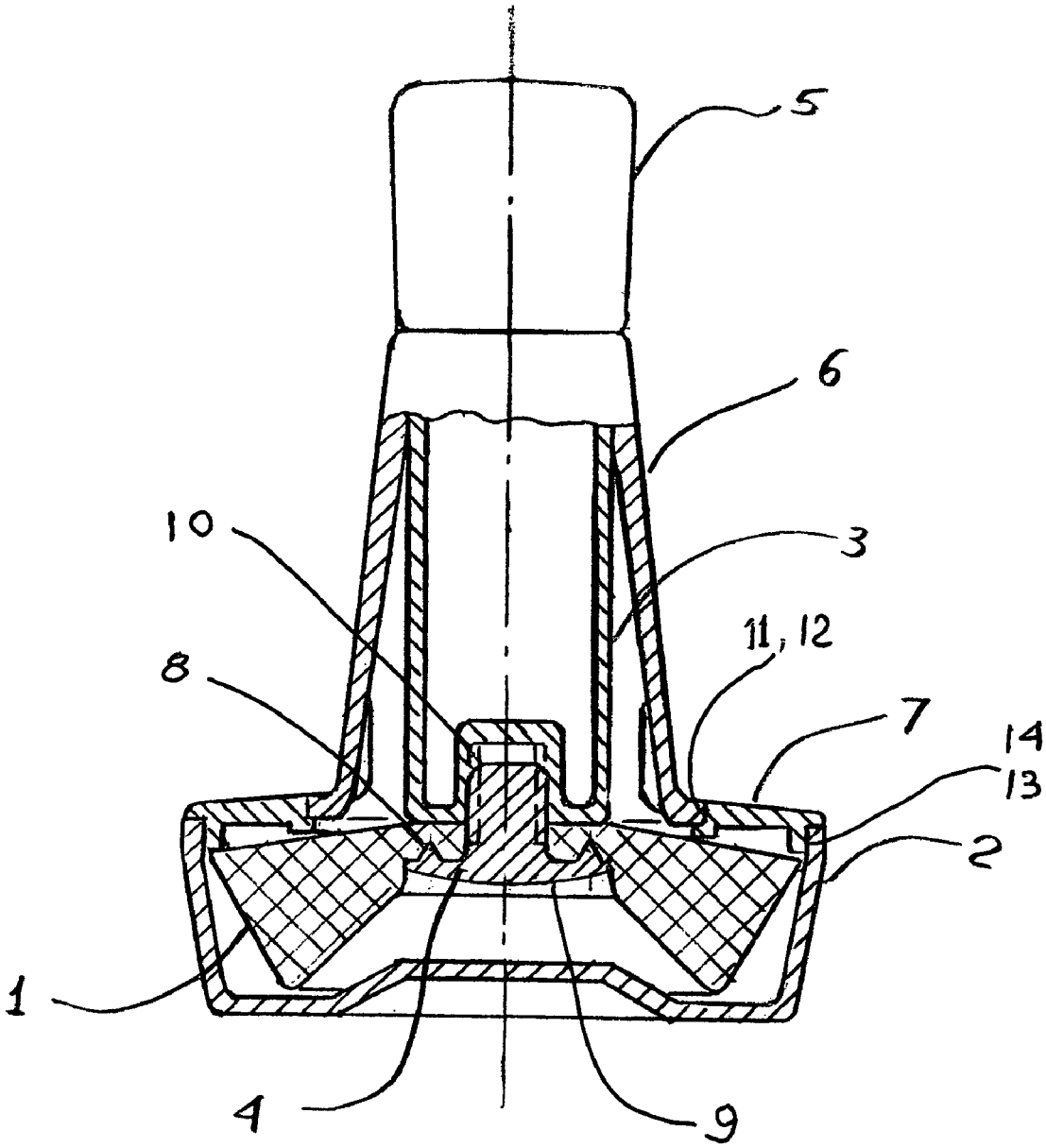
FIG. 1 is a view showing a cross-section of the cleaning device in accordance with the present invention in an assembled condition.

The cleaning device in accordance with the present invention has a sponge-like working element which is identified with reference numeral 1. The sponge-like working element 1 has a lower side, a peripheral side, and an upper side. The device has a container 2 in which the sponge-like working element 1 can be stored when it is not in use. The container 2 can be also filled with liquid so as to keep the sponge-like working element wet.

The cleaning device further has a displacing element 3, to which the sponge-like working element 1 can be connected for example by a screw 4. The displacing element which is formed as a handle has a knob 5 and is movable in a conical cup-shaped housing 6 wherein the housing 6 has two axial ends and is closed at one of the ends by the displacing element 3.

The cleaning device is further provided with a detachable plate 7. As can be seen from FIG. 1, the plate 7 in an installed position extends radially outwardly so as to form an element located above the sponge-like working element 1. As can be seen from FIG. 1, the plate 7 extend between the housing 6 and the container 2 and is removably connected with both.

For this purpose the lower edge 11 of the housing 6 is inserted into an inner groove 12 on an upper side of the plate 7 with a certain pressure, while an upper edge 13 of the container 2 is inserted with a certain pressure into an outer groove 14 on a lower side of the plate 7. The plate 7 can be composed of yieldable material, for example yieldable plastic, so that it is possible to install it in the above-described fashion, and also to remove it as will be explained herein below.

Figure 2:
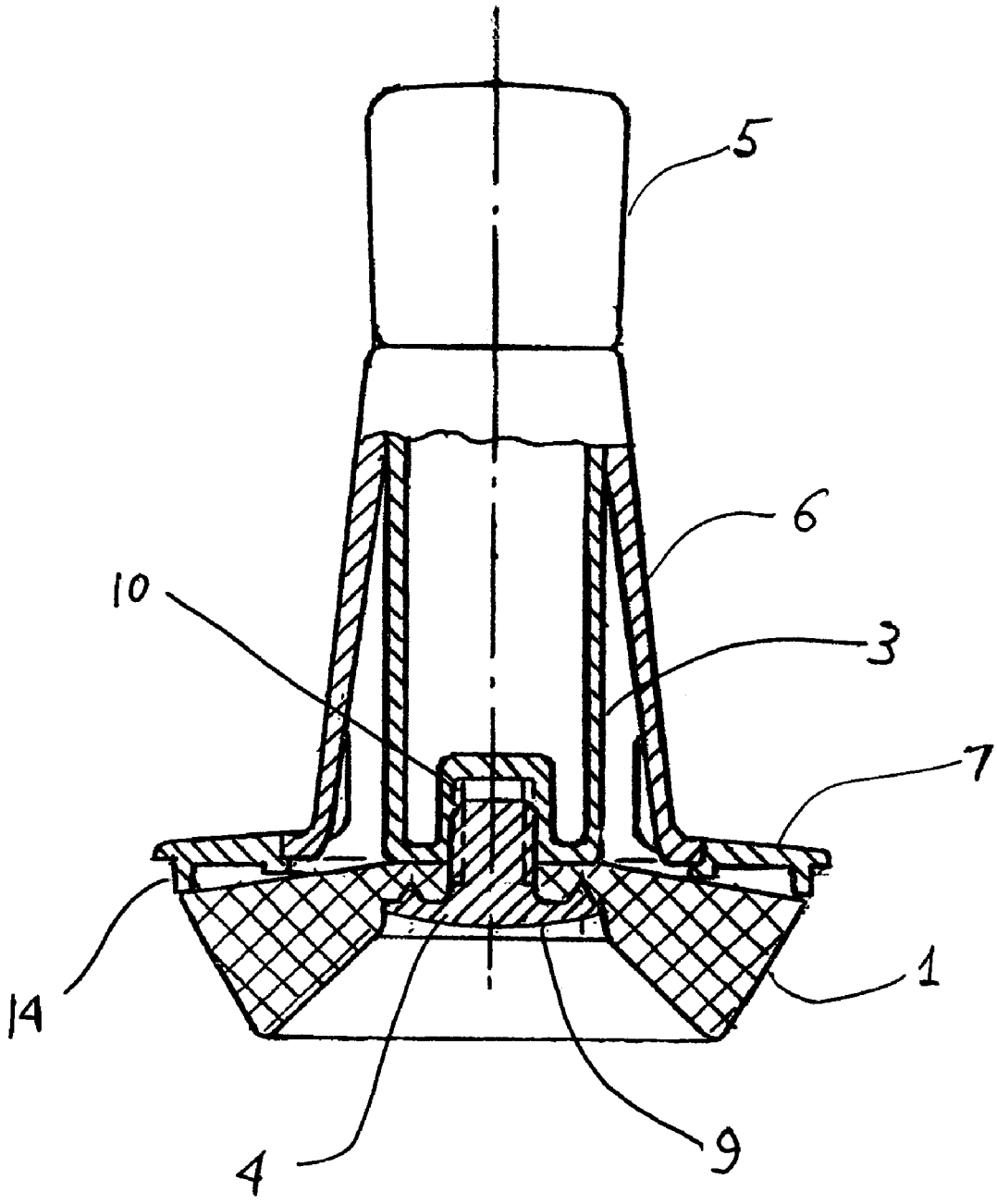
FIG. 2 is a view showing a cleaning device without a lower container and with a plate with which the user can apply a pressure from above to a sponge-like working element.
Figure 3:
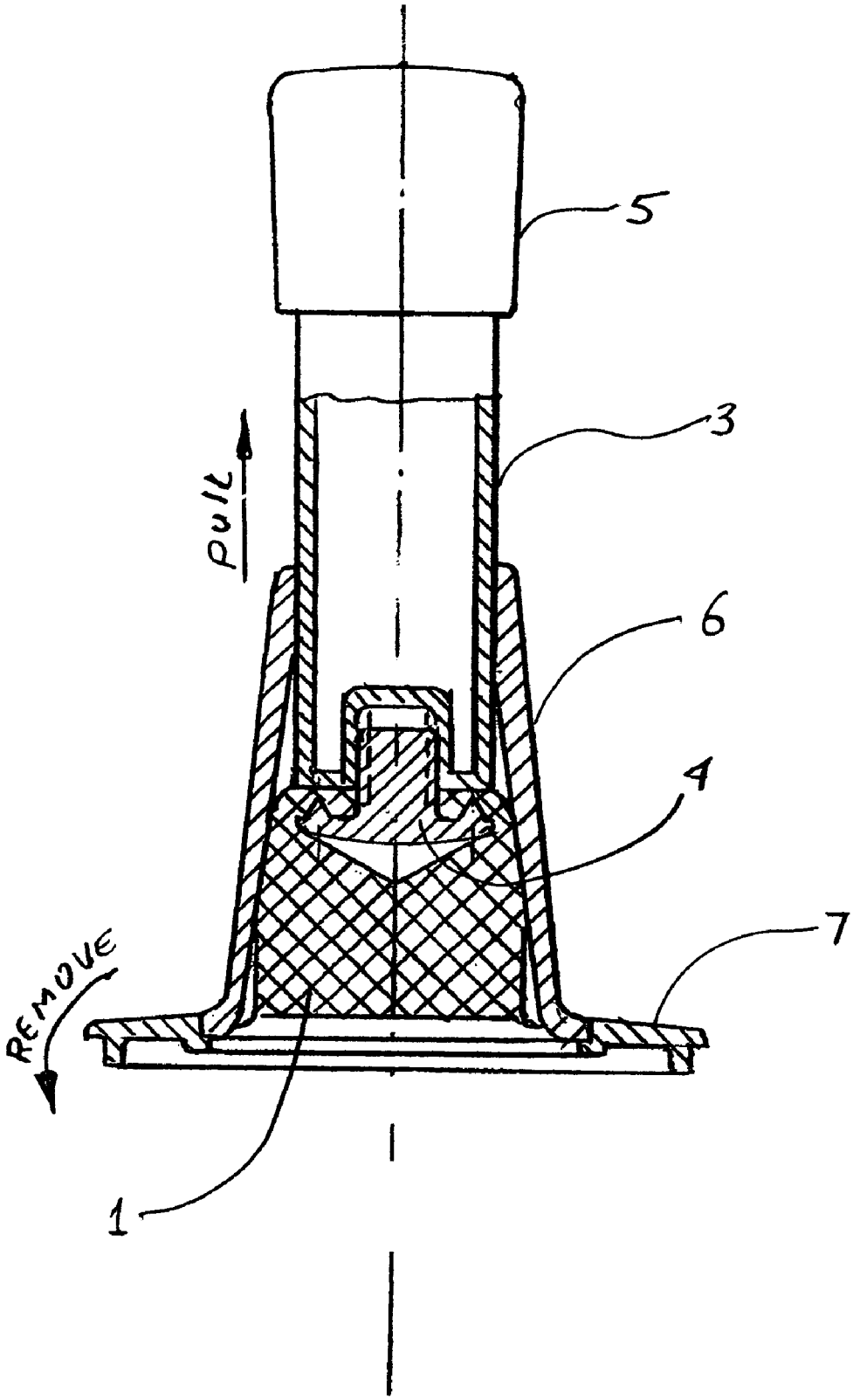
FIG. 3 is a view showing the cleaning device in a position, in which the sponge-like working element is forcedly introduced into the housing of the device to be squeezed.

When it is necessary to clean flat surfaces, the container 2 is removed, the plate 7 is installed being connected with the housing 6. A user holds the cleaning device so as to apply with his hand a pressure on the plate 7 and therefore on the sponge-like working element from above and moves the device along the flat surface to be cleaned, as shown in FIG. 2.

After the use, the sponge-like working element can be rinsed and squeezed. By pulling the displacing element and turning it in clockwise direction, the sponge-like working element 1 is pulled into the interior of the housing 6 and is squeezed.

Figure 4:
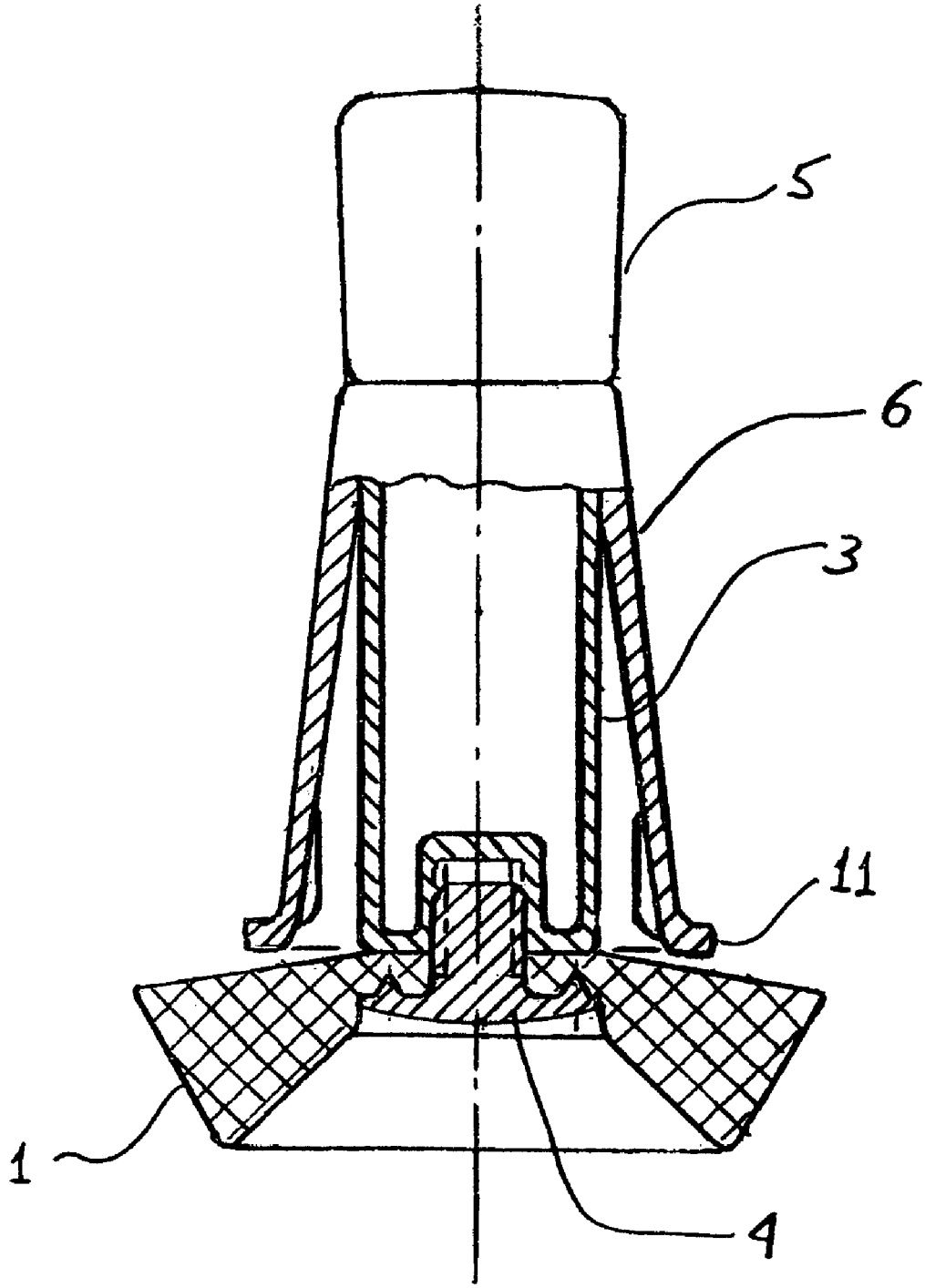
FIG. 4 is a view showing the cleaning device in which the plate is removed, so that the sponge-like working element has an exposed upper surface, in addition to other surfaces, to form an exposed side edge introducible into difficult-to-access objects.
Figure 5:
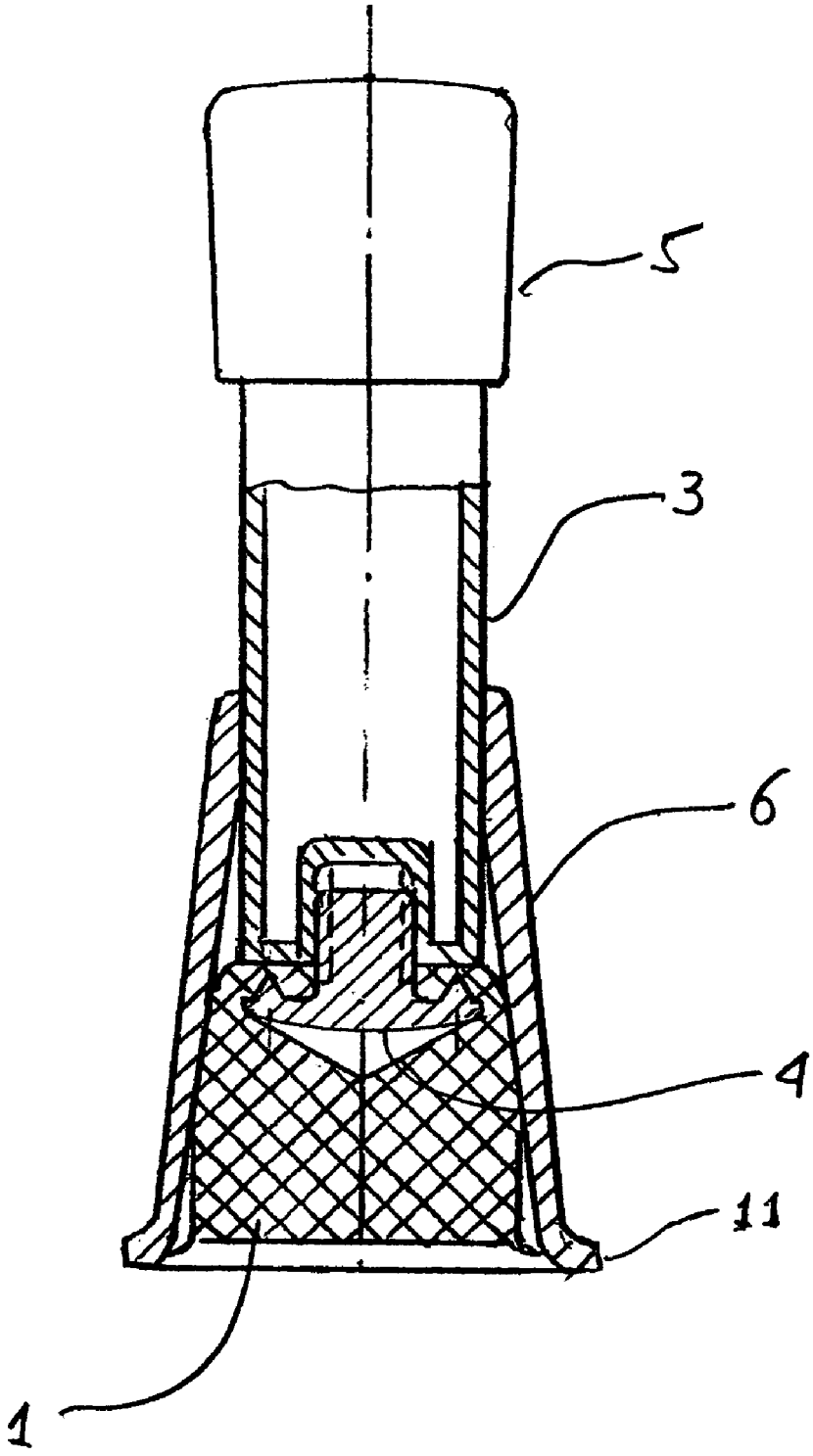
FIG. 5 is a view showing the cleaning device with the sponge-like working element, forcedly introduced into the housing to be squeezed prior to its placing on a plate and on a container.
Figure 6:
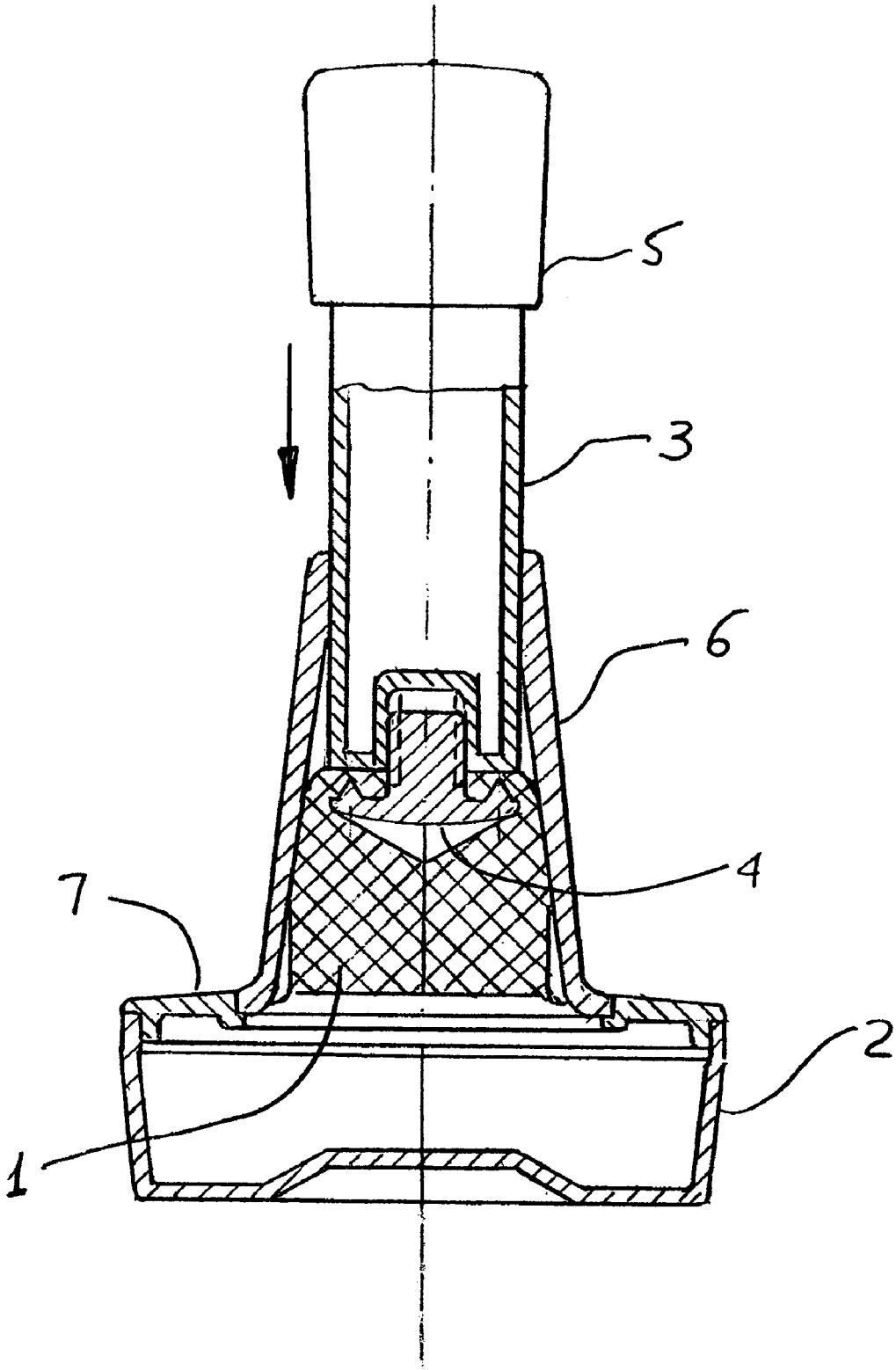
FIG. 6 is a view showing placing of the sponge-like working element in a container.

When it is necessary to clean objects which are difficult to access, such as for example dishes, plates, glasses, cups, sinks, faucets, etc., the plate 7 is removed as shown in FIG. 4. As a result, the upper side of the sponge-like working element 1 is exposed, together with the peripheral side and the lower side, so that the sponge-like working element 1 can be introduced with its lateral edge into areas which are difficult to access, as shown in FIG. 4.

After the use the sponge-like working element 1 can be again pulled into the interior of the housing 6 and squeezed. Thereafter by slowly pushing the knob 5 with the displacing element 3, the sponge-like working element 1 is introduced into the container 2, the cover 7 is attached to the container 2 to close it, and the sponge like working element 1 can be stored when not in use.

As can be seen from FIG. 1, the screw 4 which holds the sponge like working element 1 is screwable into a threaded opening 10 of the displacing element 3. The screw 4 is provided with a plurality of projections 8 which are preferably conical and has a screw head 9.

In order to remove or replace the sponge-like working element a user presses the screw head 9 and rotates the displacing element 3 to unscrew the screw 4 with the working element 1. The projections 8 which are engaged into the sponge-like working element and prevent the relative rotation during its squeezing.

It will be understood that each of the elements described above, or two or more together, may also find a useful application in other types of constructions differing from the types described above.

While the invention has been illustrated and described as embodied in cleaning device with sponge-like working element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A cleaning device, comprising a housing having a substantially vertical axis; a sponge-like working element movable between a working position in which said sponge-like working element is located outside said housing for cleaning a surface, and a position in which said sponge-like working element is forcedly moved into an inner hollow in said housing so as to be squeezed and therefore to expel liquid from said sponge-like working element; and a removable plate which in an installed position extends substantially radially above said sponge-like working element so that a user can apply an action to said plate from above and therefore to apply an action on said sponge-like working element from above toward a surface to be cleaned substantially over a whole radial extension of said sponge-like element while when said plate is removed said sponge-like working element is exposed from above and can be used with its lower, peripheral, and upper sides and with its lateral edge to extend into areas to be cleaned which are difficult to access; and a displacing element which is connected with said sponge-like working element and displaces said sponge-like working element between said positions, wherein said displacing element is turnable about said axis so that when said displacing element moves said sponge-like working element from said inner hollow to said working position, said displacing element is turnable and turns said sponge-like working element about said axis.

2. A cleaning device, comprising a housing having a substantially vertical axis; a sponge-like working element movable between a working position in which said sponge-like working element is located outside said housing for cleaning a surface, and a position in which said sponge-like working element is forcedly moved into said housing so as to be squeezed and therefore to expel liquid from said sponge-like working element; and a removable plate which in an installed position extends substantially radially above said sponge-like working element so that a user can apply an action to said plate from above and therefore to apply an action on said sponge-like working element from above toward a surface to be cleaned substantially over a whole radial extension of said sponge-like element, while when said plate is removed said sponge-like working element is exposed from above and can be used with its lower, peripheral, and upper sides and with its lateral edge to extend into areas to be cleaned which are difficult to access; and a displacing element which is connected with said sponge-like working element and displaces said sponge-like working element between said positions, wherein said housing has two axial ends and is closed at one of said axial ends by said displacing element; and further comprising a container closing said housing at another axial end and accommodating said sponge-like working element for storage.

3. A cleaning device as defined in claim 2, wherein said plate extends between said housing and said container and is removably connected therewith; and further comprising means for removably connecting said plate with said housing and said container.

4. A cleaning device as defined in claim 1; and further comprising a screw element which is provided with a plurality of projections engaging into said sponge-like working element so as to be connected with the latter and to prevent the latter from rotation during squeezing, said screw element being threadingly connected with said displacing element so as to be disconnectable from said displacing element for renewal of said sponge-like working element.

* * * * *